US007210434B2

(12) United States Patent
Kim

(10) Patent No.: US 7,210,434 B2
(45) Date of Patent: May 1, 2007

(54) HYDRAULIC CAM FOR VARIABLE TIMING/DISPLACEMENT VALVE TRAIN

(75) Inventor: Tae-kyung Kim, Sterling Heights, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/156,262

(22) Filed: Jun. 17, 2005

(65) Prior Publication Data

US 2006/0283409 A1 Dec. 21, 2006

(51) Int. Cl.
*F01L 9/02* (2006.01)

(52) U.S. Cl. ..... 123/90.12; 123/90.15; 123/198 F; 251/149; 251/149.1

(58) Field of Classification Search ..... 123/90.12
See application file for complete search history.

(56) References Cited

U.S. PATENT DOCUMENTS 4,479,512 A * 10/1984 Ohrendorf et al. ..... 137/625.17
5,056,478 A 10/1991 Ma
5,456,221 A * 10/1995 Schechter ..... 123/90.12
5,562,070 A 10/1996 Schechter et al.
6,666,181 B2 12/2003 Smith et al.
6,694,934 B1 2/2004 Preston et al.

* cited by examiner

*Primary Examiner*—Thomas Denion
*Assistant Examiner*—Kyle M. Riddle
(74) *Attorney, Agent, or Firm*—Jaquez & Associates; Martin J. Jaquez, Esq.; Lisa M. Griffith, Esq.

(57) ABSTRACT

A hydraulic fluid cam providing variable valve actuation in an engine is disclosed. In one embodiment, the hydraulic fluid cam is adapted to vary valve timing while holding valve displacement constant. In another embodiment, the hydraulic fluid cam is adapted to vary valve displacement, while holding valve timing constant. Some embodiments are adapted to vary both valve timing and displacement simultaneously to optimize engine performance.

20 Claims, 9 Drawing Sheets

FIGURE 3Aiii

FIGURE 3Aii

FIGURE 3Biii

FIGURE 3Bii

FIGURE 3Ciii

FIGURE 3Cii

HYDRAULIC CAM FOR VARIABLE TIMING/DISPLACEMENT VALVE TRAIN

BACKGROUND

1. Field

The present disclosure generally relates to engine valve control systems, and particularly to valve control systems using variable valve timing and variable displacement.

2. Related Art

The optimum times for opening and closing the inlet and exhaust valves in an engine vary, inter alia, with engine speed. In any engine having fixed angles for opening and closing of valves during all engine operating conditions, valve timing is an important design consideration. In many cases, valve timing detracts from engine efficiencies in all but a limited range of operating conditions. For this reason, it has been previously proposed to dynamically vary valve timing during engine operation in order to accommodate different operating conditions.

Hydraulic camshafts are used to regulate valves in an engine combustion chamber. Valve regulation includes both valve timing and valve displacement inside the engine combustion chamber. Valve timing controls both the opening time and the closing time for valves. Valve displacement comprises the distance (lift) that a valve opens and the duration for which the valve is open.

The conventional camshaft-actuated valve gear train is a compromise solution as far as engine efficiency and performance is concerned. For example, at relatively low speeds and loads, the engine valves typically open more than is needed, while at relatively higher engine speeds, the valves typically do not open enough to allow the flow quantity of air-fuel mixture necessary to achieve optimum engine performance. At relatively low speeds, if the amount of valve opening could be reduced, such that the poppet valve could serve as a flow "throttle", engine pumping losses could be reduced. A poppet valve is an intake or exhaust valve, operated by springs and cams that plugs and unplugs an opening by axial motion.

In some engines, variation of valve timing has been proposed as a means for regulating engine output power. For example, if the inlet valve is allowed to remain open for part of a compression stroke, the volumetric efficiency of an engine can be reduced. Such an engine requires an increased control range over the phase of the hydraulic camshaft. Furthermore, the control needs to be continuous over the full adjustment range.

It has been observed that improvements to engine efficiency can be achieved by varying the timing of the opening and closing of the valves as a function of engine speed, and also as a function of engine load. One known mechanism used to vary the timing of the opening and closing of the engine valves is a variable cam phase change device. The variable cam phase change device is used to vary the angular position of the camshaft, relative to the angular position of the crankshaft.

Various proposals have been suggested for mechanisms used to adjust the camshaft phase angle relative to the crankshaft. However, the suggested mechanisms typically are very complex because of the need to withstand considerable torque fluctuations experienced by a camshaft during normal operation. The camshaft phase angle adjustment mechanism must also supply force sufficient to rotate the camshaft against the resistance provided by the compressed valve springs.

Electro-mechanical valve-actuated systems have been proposed that vary either valve timing or valve displacement. However, it is desirable to simultaneously control both valve timing and valve displacement in a hydraulic valve-actuated system. The present teachings disclose a hydraulic system that varies both valve timing and valve displacement in an engine.

SUMMARY

An improved hydraulic variable valve train apparatus is disclosed. The apparatus is adapted for use in an engine having a combustion chamber, a hydraulic camshaft rotating in timed relationship with a combustion sequence occurring in the combustion chamber, wherein the hydraulic camshaft rotates along a circumferential axis of rotation of the hydraulic camshaft. In one embodiment, the improved hydraulic variable valve train comprises a first graduated cavity disposed on a first portion of a hydraulic camshaft lobe and a second graduated cavity disposed on a second portion of the hydraulic camshaft lobe, wherein the hydraulic camshaft lobe concentrically rotates with the circumferential axis of rotation of the hydraulic camshaft. The improved apparatus has at least one valve operatively coupled to the hydraulic camshaft lobe and a hydraulic circuit adapted to actuate the valve in the engine. The hydraulic circuit comprises a hydraulic fluid source operatively coupled to the hydraulic camshaft lobe via a first inlet portion disposed at a first inlet port on the hydraulic camshaft and a second inlet portion disposed at a second inlet port on the hydraulic camshaft. The hydraulic circuit further comprises a first control port operatively connected to a first control port side of the hydraulic camshaft lobe and a second control port operatively connected to a second control port side of the hydraulic camshaft lobe, a first exhaust port operatively connected to a first exhaust port side of the hydraulic camshaft lobe and a second exhaust port operatively connected to a second exhaust port side of the hydraulic camshaft lobe.

An improved hydraulic fluid cam apparatus adapted for use in an engine is also disclosed. The improved hydraulic fluid cam apparatus comprises a first cavity having a first predetermined shape disposed on a hydraulic camshaft lobe, wherein the first predetermined shape has a first width on a first portion of the hydraulic camshaft lobe and a second width, narrower than the first width, on a second portion of the hydraulic camshaft lobe.

In another embodiment, an improved variable valve train apparatus; adapted for use in an internal combustion engine having a combustion chamber is disclosed. In this embodiment, the improved variable valve train includes a hydraulic camshaft; rotating in timed relationship with a combustion sequence occurring in the engine combustion chamber, wherein the hydraulic camshaft rotates along a circumferential axis of rotation of the hydraulic camshaft. The apparatus comprises at least a first cavity disposed on a first portion of a hydraulic camshaft lobe, wherein the hydraulic camshaft lobe rotates concentrically with the circumferential axis of rotation of the hydraulic camshaft and has at least one valve operatively coupled to the hydraulic camshaft lobe.

In another embodiment, a valve actuation apparatus, adapted for use in a hydraulic fluid cam, is disclosed. The apparatus comprises a hydraulic camshaft lobe having at least a first main cavity having a depth and a width associated therewith. The apparatus further comprises at least one additional cavity having a variable width and a variable depth associated therewith, and at least one additional cavity actuation mechanism associated with the at least one additional cavity, adapted to vary the width and further adapted to vary the depth of the at least one additional cavity.

In another embodiment, a valve actuation means, operatively coupled to a hydraulic camshaft lobe for varying poppet valve timing while simultaneously varying poppet valve displacement in a combustion chamber of an engine, is disclosed. The valve actuation means comprises a sliding cavity means operatively connected to the hydraulic camshaft lobe and a sliding cavity actuation means operatively coupled to the sliding cavity means.

BRIEF DESCRIPTION OF THE DRAWINGS

Embodiments of the present invention will be more readily understood by reference to the following figures, in which like reference numbers and designations indicate like elements.

FIG. 3Aii illustrates a side view of the improved hydraulic fluid cam apparatus of FIG. 3Ai.

FIG. 3Aiii illustrates a valve displacement diagram corresponding to FIG. 3Ai and FIG. 3Aii.

FIG. 3Bii illustrates a side view of the improved hydraulic fluid cam apparatus of FIG. 3Bi.

FIG. 3Biii illustrates a valve displacement diagram corresponding to FIG. 3Bi and FIG. 3Bii.

FIG. 3Cii illustrates a side view of the improved hydraulic fluid cam apparatus of FIG. 3Ci.

FIG. 3Ciii illustrates a valve displacement diagram corresponding to FIG. 2Ci and FIG. 3Cii.

DETAILED DESCRIPTION

The present disclosure provides for variable valve timing and variable valve displacement control, either separately or simultaneously, in a hydraulic fluid cam. In one embodiment, at least one cavity is disposed on a cam lobe to actuate a valve. In another embodiment, a plurality of cavities are disposed on a cam lobe for valve actuation. In one embodiment, a plurality of main cavities are disposed on a first portion of a cam lobe and at least one additional cavity is disposed on a second portion of the cam lobe. This embodiment includes a sliding apparatus adapted to vary a width and a depth of the additional cavity.

The variable valve actuation apparatus of the present disclosure is not limited to any particular configuration or arrangement of the cylinder head. Nor is the variable valve activation apparatus limited to any particular style or configuration of rocker arm assembly. Further, the disclosed variable valve activation apparatus is not limited to a valve gear train which includes a rocker arm assembly. Although some embodiments are described in terms of an internal combustion engine, such exemplary embodiments should not limit the engine types that may be used with the present disclosed valve activation apparatus.

Referring now to FIGS. 1A–1J, an improved hydraulic variable valve train apparatus is disclosed. The improved hydraulic variable valve train apparatus is generally adapted to provide both variable valve displacement and variable valve timing in a hydraulically actuated system.

Figure 1A:
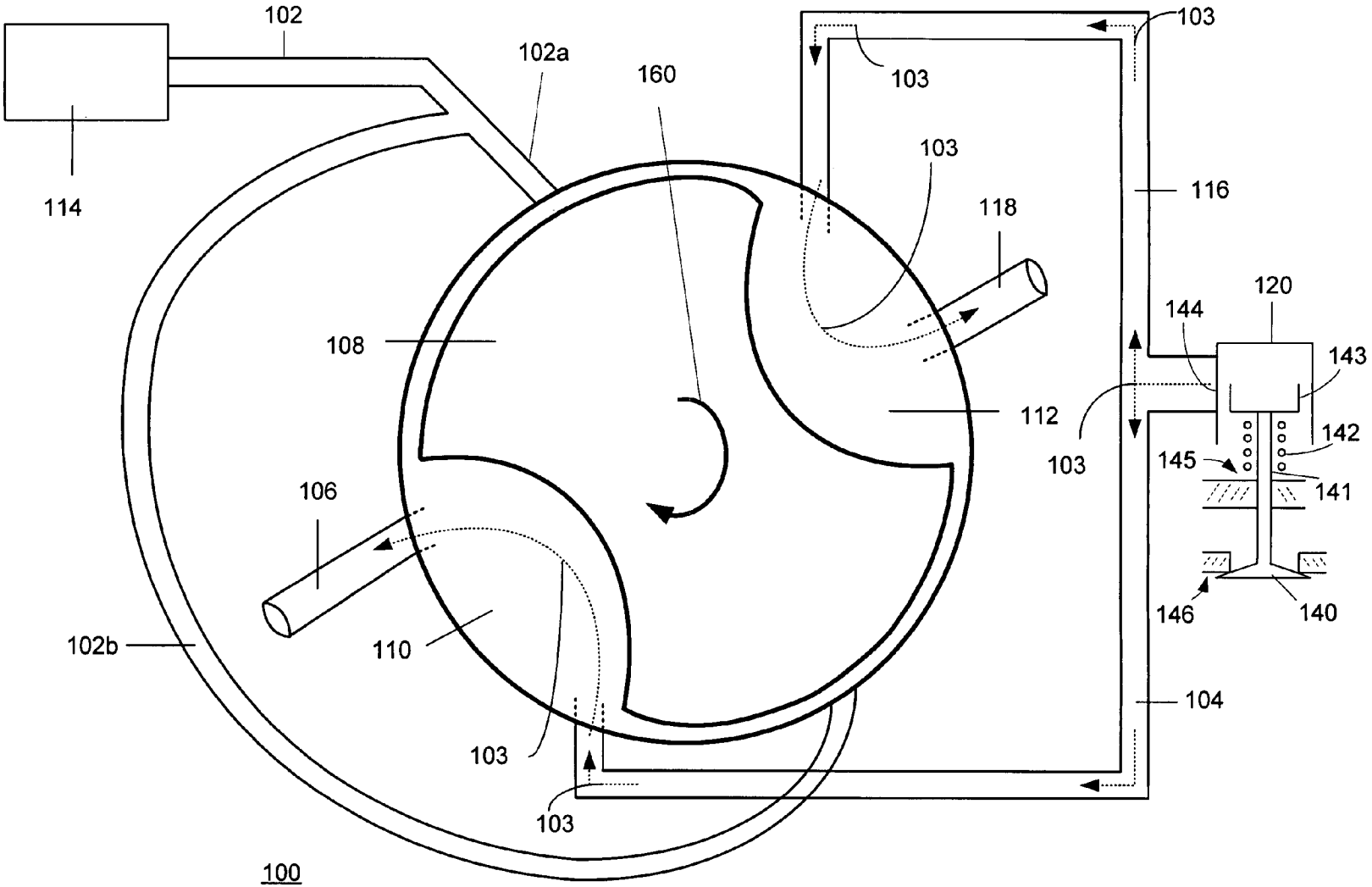
FIG. 1A illustrates a cross-sectional view of an improved variable valve train apparatus, in an exhaust position.

Referring now to FIG. 1A, one embodiment of an improved variable valve train apparatus, having a valve 140 shown in a closed position, is illustrated. A cross-section of a hydraulic camshaft lobe 108 of the exemplary hydraulic variable valve train is illustrated in FIG. 1A. FIG. 1A shows the hydraulic camshaft lobe 108 in an "exhaust" position. The hydraulic camshaft lobe 108 is used in the combustion chamber (not shown) of an engine. The hydraulic camshaft lobe 108 typically rotates concentrically about a circumferential axis of rotation 160. In one embodiment, the hydraulic camshaft lobe 108 includes a first graduated cavity 110 disposed on a first portion of the hydraulic camshaft lobe 108. Similarly, on a second portion of the hydraulic camshaft lobe 108 is included a second graduated cavity 112. As described in more detail below, the cavities 110 and 112 are "graduated" in the sense that the contour of the cavities 110 and 112 have a continuous slope of changing depth from a first width (having a first depth) to a second width (having a second depth), wherein the first width differs from the second width, and wherein the first depth also differs from the second depth. The variations in both depth and height vary along an axis that is perpendicular with respect to the page of FIGS. 1A–1I. Hence, FIGS. 1A–1I illustrates cross-sectional views of a portion of the graduated cavities 110 and 112. In this embodiment, at least one valve 140 protrudes into the combustion chamber on the poppet end of the valve 140, and is operatively coupled to the hydraulic camshaft lobe 108 via a valve stem 141 end of the valve 140.

As described above, FIG. 1A illustrates the hydraulic camshaft lobe 108 in an "exhaust" position. Hydraulic camshaft lobe 108 is said to be in the exhaust position because the relative positioning of the first and second graduated cavities 110 and 112 create an operative connection between the control port 104 and the exhaust port 106. Similarly, the exhaust position of the hydraulic camshaft lobe 108 also creates an operative fluid communication or coupling between the control port 116 and the exhaust port 118. Hence, in the exhaust position, the hydraulic camshaft lobe 108 creates a fluid coupling or communication that allows for the evacuation of exhaust gases from the combustion chamber, via the control ports 104 and 116, through the graduated cavities 110 and 112, and into the exhaust ports 106 and 118 respectively.

The hydraulic circuit 100 is adapted to actuate the valve 140 into open and closed positions. FIG. 1A illustrates the valve 140 in a closed position. When there is no hydraulic force exerted on the actuator interface 144, a spring 142 exerts a force on the valve stem 141, which functions to push a piston 143, within an actuator 120, away from a valve guide 145, thereby moving the valve 140 into the closed position. A mating surface 146 is a valve seat. In one embodiment, the mating surface 146 is an intake port, functioning (in FIG. 1A) to seal off (prevent) fuel flow into the combustion chamber. In another embodiment, the mating surface 146 is an exhaust port, functioning (in FIG. 1A) to seal the combustion chamber, thereby preventing any gaseous fluids from escaping the combustion chamber. A plurality of arrows 103 in FIG. 1A illustrate a direction of fluid flow toward the control ports 104 and 116 when the valve 140 is in the closed position.

Figure 1B:
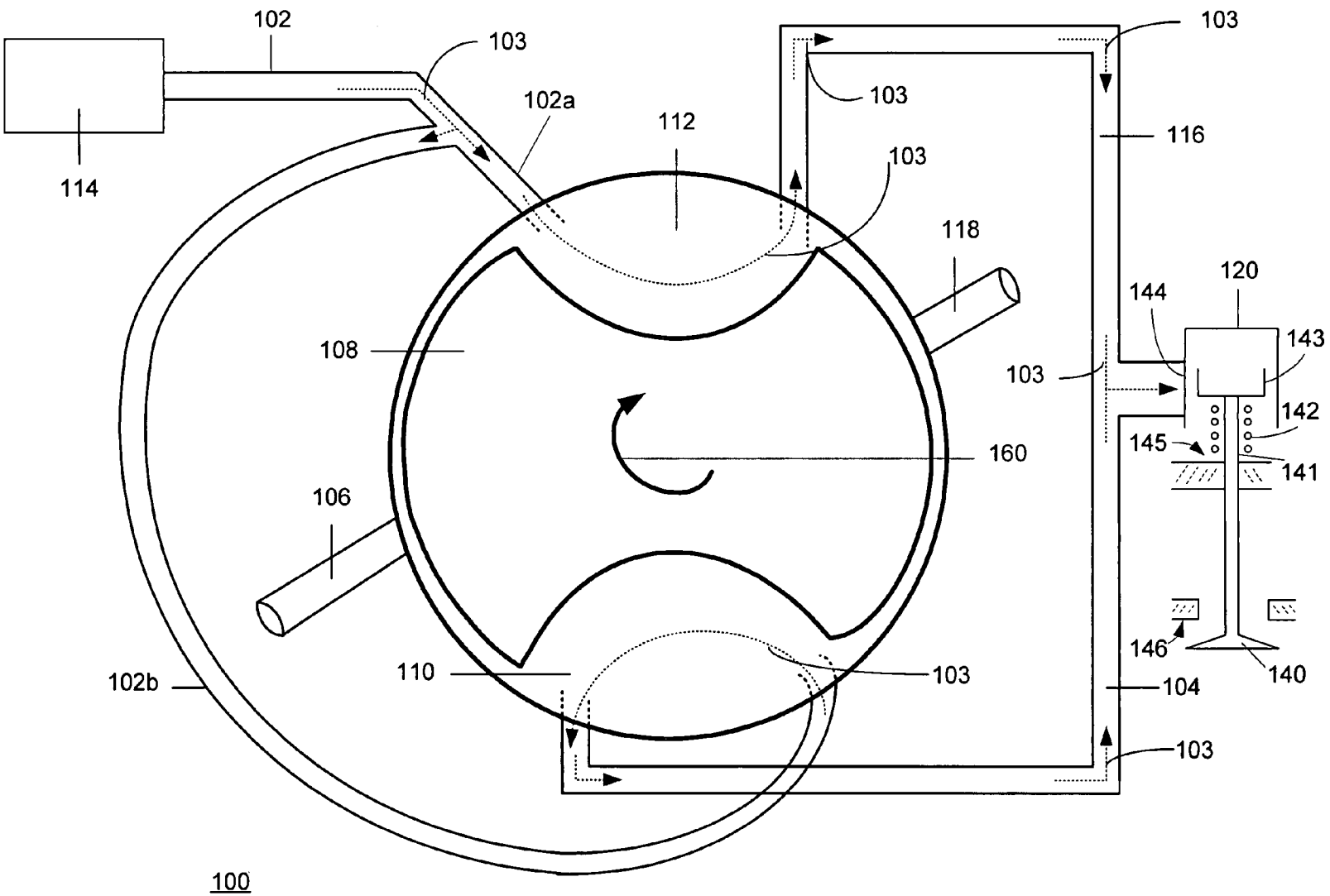
FIG. 1B illustrates a cross-sectional view of an improved variable valve train apparatus, in an inlet position.

Referring now to FIG. 1B, an embodiment of an improved hydraulic variable valve train apparatus having a valve 140 is shown in an open position. In this embodiment, the hydraulic camshaft lobe 108 has moved from the exhaust position (as shown in FIG. 1A) to an "inlet" position, as denoted by the rotation of the circumferential axis of rotation 160. The first and second graduated cavities 110 and 112 remain stationary with respect to the hydraulic camshaft lobe 108 throughout the rotation of the axis of rotation 160, as the cavities 110 and 112 rotate concentrically with camshaft lobe 108. Hence, as the camshaft lobe 108 rotates from the exhaust position (of FIG. 1A) to the inlet position (of FIG. 1B), the previously described fluid communication or coupling between the control port 104 and the exhaust port 106 is disconnected. Similarly, when the camshaft lobe 108 rotates from the exhaust position to the inlet position, the above described fluid connectivity between the control port 116 and the exhaust port 118 is also disconnected.

As shown in FIG. 1B, the poppet valve 140 is in an open position, with respect to the mating surface 146. In one embodiment, the mating surface 146 is an intake port, functioning (in FIG. 1B) to pass (allow) fuel flowing into the combustion chamber. In another embodiment, the mating surface 146 is an exhaust port, functioning (in FIG. 1B) to provide an opening to the combustion chamber, thereby allowing any gaseous fluids within the combustion chamber to escape from the combustion chamber.

As shown in FIG. 1B, when the camshaft lobe 108 is rotated into the inlet position, the inlet portion 102 is in fluid communication with the control ports 104 and 116. That is, when the camshaft lobe 108 is rotated into the inlet position, the inlet portion 102*a* is in fluid connectivity with the control port 116 via the graduated cavity 112. Similarly, in the inlet position, the inlet portion 102*b* is in fluid connectivity with the control port 104 via the graduated cavity 110.

When the inlet portions 102*a* and 102*b* fluidly connect with the control ports 116 and 104, respectively, hydraulic fluid provided by a hydraulic fluid source 114 create a hydraulic force (as shown by the arrows 103 in FIG. 1B) in the direction of the actuator interface 144. Hydraulic force is applied to the actuator interface 144 when hydraulic fluid is allowed to flow from the hydraulic fluid source 114 through the inlet portion 102*a* to the control port 116 via the graduated cavity 112. Similarly, hydraulic force is applied to the actuator interface 144 when hydraulic fluid is allowed to flow from the hydraulic fluid source 114, through the inlet portion 102*b*, to the control port 104 via the graduated cavity 110.

In one embodiment of the disclosed variable valve train apparatus, the hydraulic fluid source 114 comprises a hydraulic fluid pump. In another embodiment, the hydraulic fluid source 114 comprises a hydraulic fluid reservoir. In some embodiments, the hydraulic fluid comprises oil. However, it will be appreciated by those skilled in the valve arts that literally any convenient hydraulic fluid may be used to practice the present teachings.

In one embodiment of the present variable valve train apparatus, valve timing and displacement can be varied as hydraulic camshaft lobe 108 moves along a longitudinal axis of the camshaft. Referring to FIGS. 1A–1I, the longitudinal axis of the camshaft is perpendicular (vertical) with respect to the page of FIGS. 1A–1I. As the hydraulic camshaft lobe 108 moves along the longitudinal axis of the camshaft, the graduated cavities 110 and 112 vary in both depth and width. This action, in turn, simultaneously varies the valve timing and valve displacement within the hydraulic fluid cam. Valve timing determines when the valve is opened and closed. Valve displacement determines the amount of valve lift and the duration of the valve lift. In one embodiment, valve timing alone is varied as the hydraulic camshaft lobe 108 moves along the longitudinal axis. In another embodiment, valve displacement alone is varied as the hydraulic camshaft lobe 108 moves along the longitudinal axis.

Figure 1C:
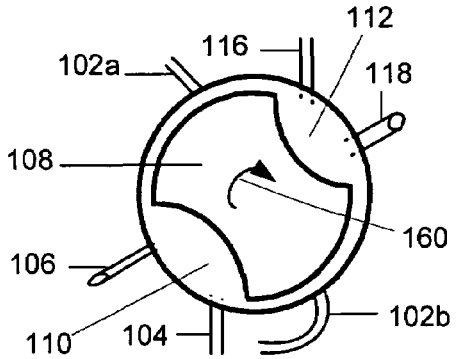
FIGS. 1C–1H illustrates sectional views, at a reduced scale, illustrating various positions of the variable valve train apparatus during engine operation.
Figure 1F:
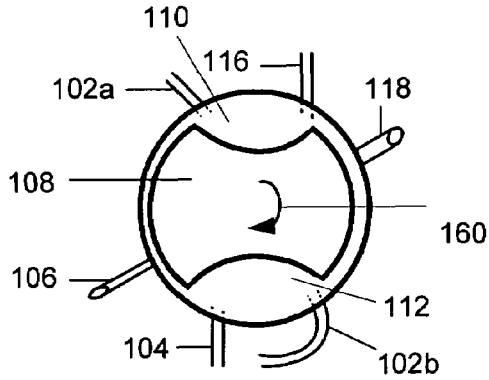
Figure 1D:
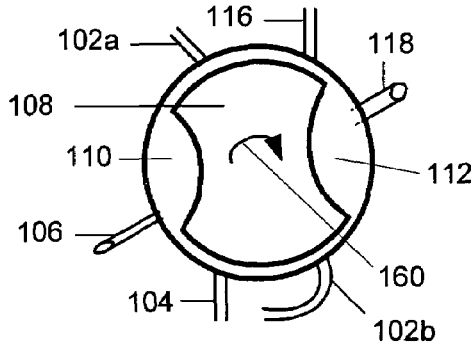
Figure 1G:
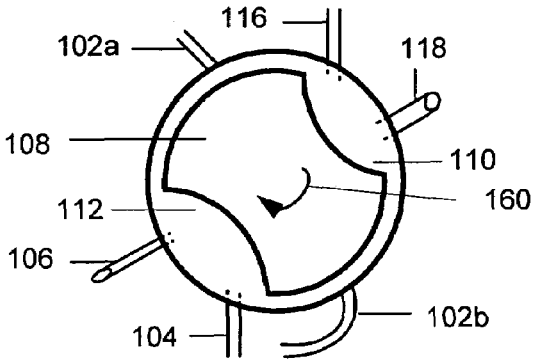
Figure 1E:
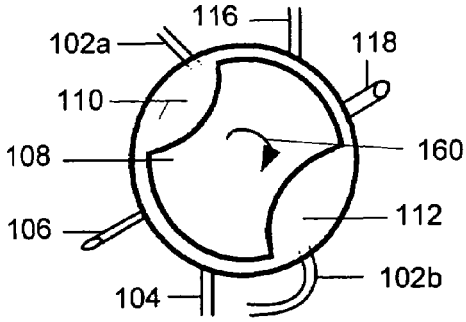
Figure 1H:
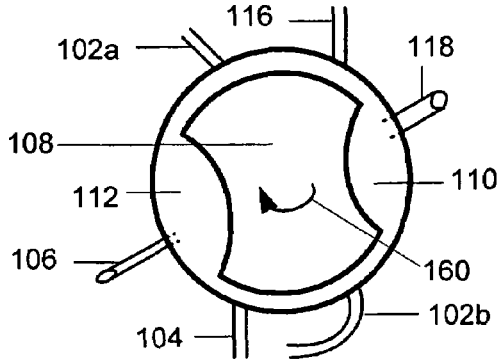

Referring now to FIGS. 1C–1H, a rotational operational sequence of the improved hydraulic camshaft lobe 108 is illustrated. FIG. 1C illustrates an exhaust position, wherein the control port 116 is fluidly coupled to the exhaust port 118 via the operation of the graduated cavity 112. Similarly, control port 104 is in fluid communication with the exhaust port 106 via the graduated cavity 110. FIG. 1D illustrates a subsequent position in the rotation of the hydraulic camshaft lobe 108, wherein the control ports 104 and 116 are no longer in fluid communication with the exhaust ports 106 and 118, respectively. FIG. 1E illustrates a subsequent position in the rotation of the hydraulic camshaft lobe 108, wherein the inlet portions 102*a* and 102*b* are fluidly coupled with the graduated cavities 110 and 112, respectively. FIG. 1F illustrates a subsequent position in the rotation of the hydraulic camshaft lobe 108, also known as an "inlet" position, wherein the inlet portion 102*a* becomes fluidly coupled to the control port 116 via the graduated cavity 110. Similarly, the inlet portion 102*b* is fluidly coupled to the control port 104 via the graduated cavity 112. FIG. 1G shows a subsequent position in the rotation of the hydraulic camshaft lobe 108, also known as the "exhaust" position, which is similar to the position shown in FIG. 1C. FIG. 1H shows a subsequent position in the rotation of the hydraulic camshaft lobe 108, which is similar to the position of FIG. 1D.

Figure 1I:
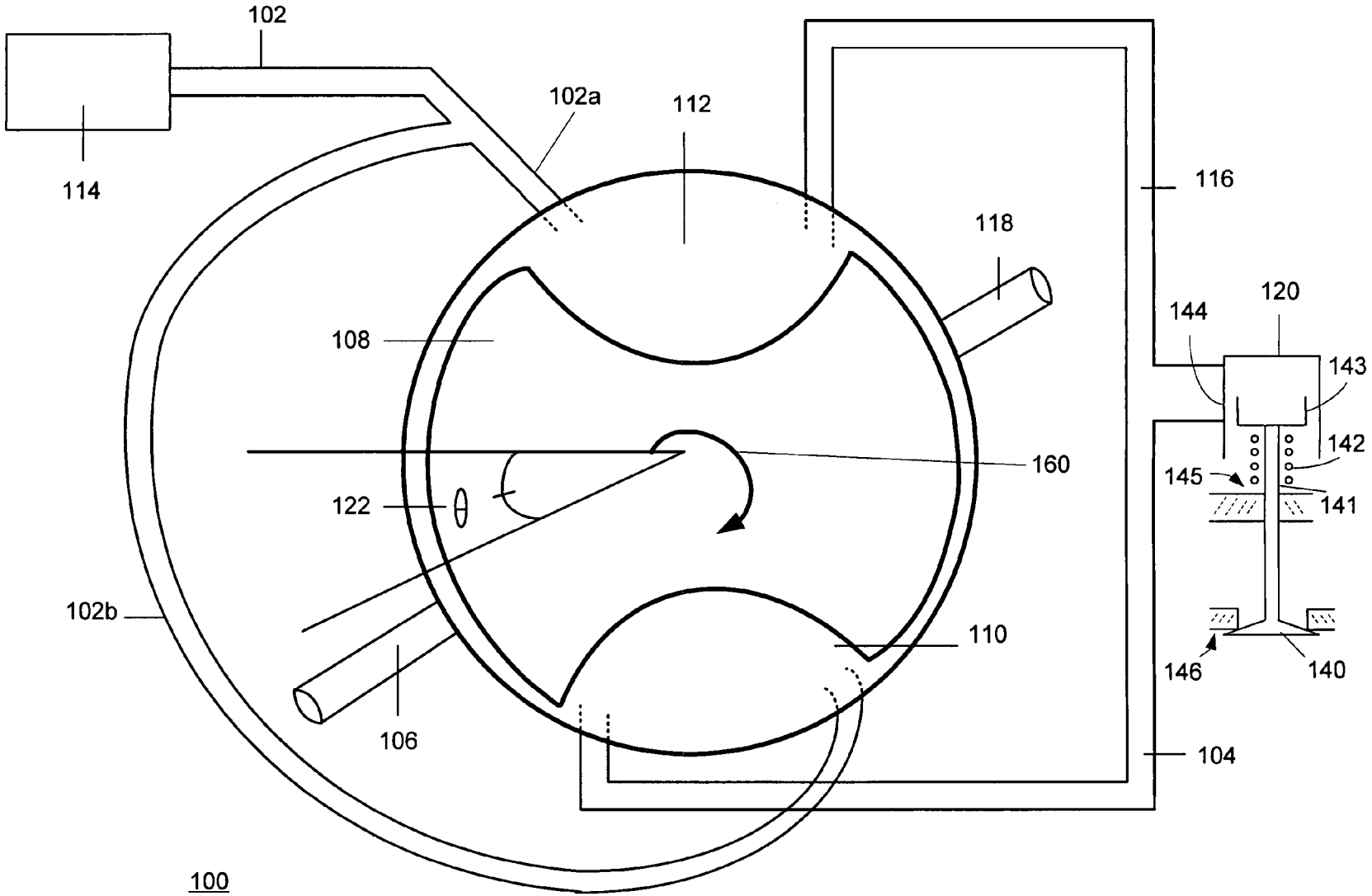
FIG. 1I shows a cross-sectional view of the variable valve train apparatus, illustrating a cam phasing angle θ.

Referring now to FIG. 1I, a cam phasing embodiment of the present improved hydraulic variable valve train apparatus is shown. FIG. 1I illustrates a cross-sectional view of an improved camshaft lobe 108 having a first cavity 110 and a second cavity 112.

In some applications it may be desirable to vary cam timing, while simultaneously holding cam displacement a constant. In these applications, the camshaft can be phased to activate the opening and closing of the valve 140 at different desired times, while not varying the displacement (valve lift and duration) of the valve 140. In accordance with one embodiment of the present apparatus, such cam phasing is accomplished by shifting an initial rotational angle of the cam lobe 108 by an initial angle θ 122. In one embodiment, this initial rotational angle is shifted relative to corresponding crankshaft timing.

Figure 2:
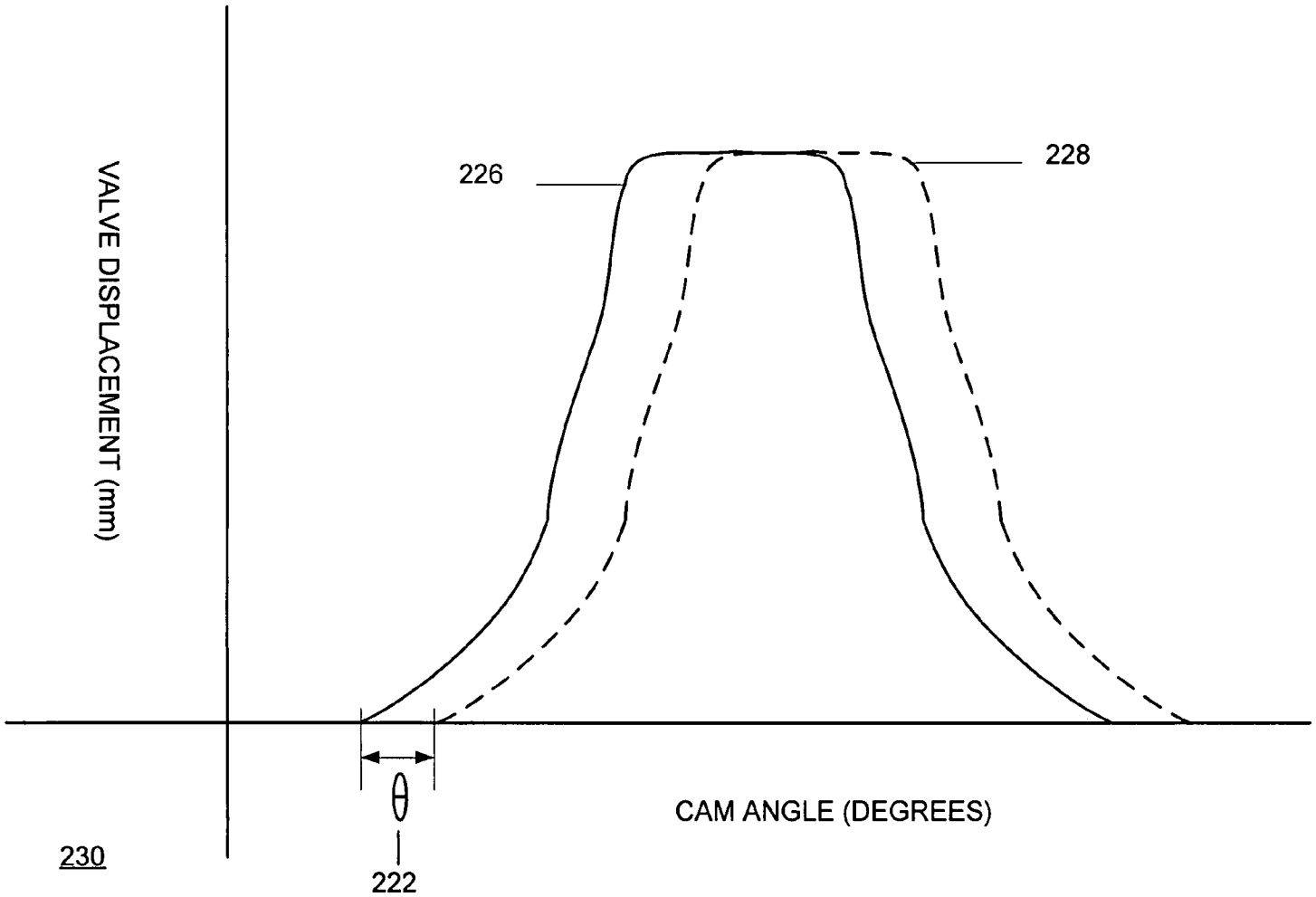
FIG. 2 illustrates a relationship between valve displacement and cam angle, showing valve actuation, corresponding to FIG. 1I.

FIG. 2 shows a graph 230 of valve displacement as a function of rotational cam angle. In one embodiment, the cam angle 226 is shifted by an initial rotational angle θ 222, which shifts the valve opening and closing time by θ degrees. As shown in FIG. 2, the cam angle graph 226 is shifted by θ degrees to cam angle graph 228.

Figure 3A:
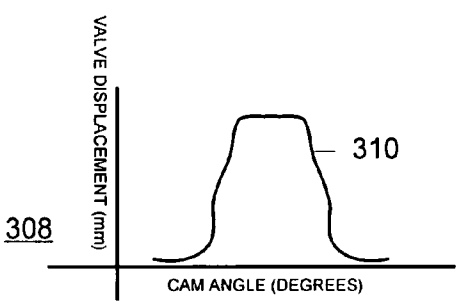
FIG. 3Ai illustrates a front view of an improved hydraulic fluid cam apparatus in a maximum displacement position.
Figure 3A:
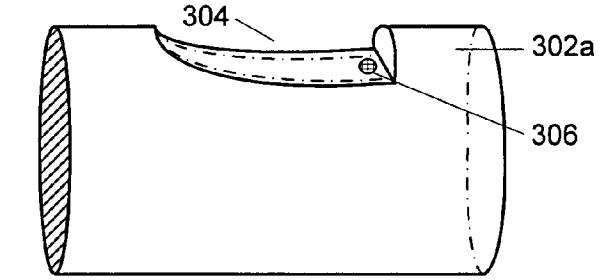
Figure 3A:
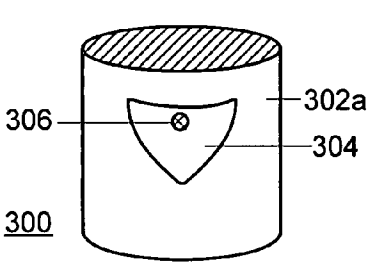

Referring now to FIGS. 3Ai, 3Aii, 3Aiii, 3Bi, 3Bii, 3Biii, 3Ci, 3Cii, and 3Ciii an improved hydraulic fluid cam apparatus is described. In this embodiment of the present disclosure, at least one valve (not shown) is operatively coupled to a camshaft lobe 300, such that the valve is actuated by a hydraulic circuit that is operatively coupled to the camshaft lobe 300 via a port 306. The fluid cam apparatus is itself mounted upon another portion of an engine system, allowing cam lobes to "slide" laterally (similar to a piston), either by mechanical, and/or electrical (e.g., solenoid), and/or other hydraulic system.

FIG. 3Ai illustrates an improved hydraulic fluid cam 300 shown in a maximum position with respect to valve timing and displacement. A first camshaft lobe position 302*a* illustrates the maximum position of the hydraulic fluid cam 300, in the sense that the port 306 is disposed at a position of maximum width and depth of a first cavity 304 having a first predetermined shape. In some embodiments, the port 306 comprises a control port, an exhaust port, and/or an inlet portion, depending upon the angle of rotation of the camshaft lobe position 302*a*. In this embodiment, as shown in FIGS. 3Ai, 3Aii and 3Aiii, the first predetermined shape has a first width, disposed at a first portion of the camshaft lobe position 302*a*, which is laterally wider across the camshaft lobe position 302*a* of the cavity 304 than at a second width, disposed at a second portion of camshaft lobe position 302*a*. In this embodiment, a wider width corresponds to earlier valve opening and later valve closing timing. As shown in FIGS. 3Ai, 3Aii and 3Aiii, when the port 306 is positioned on the first width, wherein the cavity 304 is widest (and hence the port 306 has its longest contact with the cavity 304), an earlier valve opening time and a later valve closing time results. In contrast, when the port 306 is positioned in either a "graduated" position 302*b* (shown in FIG. 3Bi) or a non-actuated position 302*c* (shown in FIG. 3Ci), as described more fully below, a delayed (or NO) valve opening time and earlier (or NO) valve closing time results.

Similarly, when in camshaft lobe position 302*a*, the cavity 304 proximate the port 306 also has an increased depth as compared to other positions of the camshaft lobe. That is, at such a first portion of the camshaft 300, the cavity 304 has a maximum depth relative to other portions of the cavity 304. At a first depth, wherein the cavity 304 is widest (and wherein the port 306 has its deepest contact with the cavity 304), a maximum displacement (lift) of the valve results. In contrast, when the port 306 is positioned in either a "graduated" camshaft lobe position 302*b* (see FIGS. 3Bi, 3Bii) or a non-actuated camshaft lobe position 302*c* (see FIGS. 3Ci and 3Cii), displacement (lift) of the valve is decreased.

FIG. 3Aii is a side view of the improved hydraulic fluid cam apparatus of FIG. 3Ai in camshaft lobe maximum position 302*a*.

FIG. 3Aiii is a maximum displacement graph 308 of valve displacement versus cam angle, corresponding to the first cavity 304 of cam lobe position 302*a* of FIG. 3Ai and FIG. 3Aii. The maximum displacement graph 308 illustrates a maximum displacement curve 310 having a horizontal portion corresponding to constant maximum displacement of a valve operatively coupled to the camshaft when at camshaft lobe position 302*a*. The horizontal portion of the maximum displacement curve 310 corresponds to the greatest distance a valve will open in a combustion chamber. The maximum valve displacement illustrated in FIG. 3Aiii corresponds directly to the positioning of the port 306 over the first portion of cavity 304 (as shown in FIGS. 3Ai and 3Aii), which portion has the maximum depth and maximum width of the cavity 304.

Figure 3B:
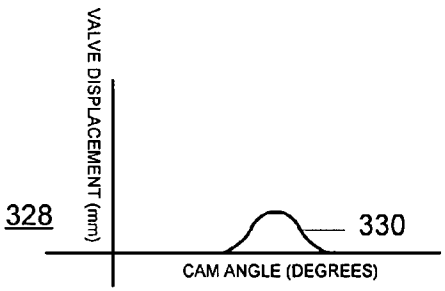
FIG. 3Bi illustrates a front view of the improved hydraulic fluid cam apparatus in a graduated position.
Figure 3B:
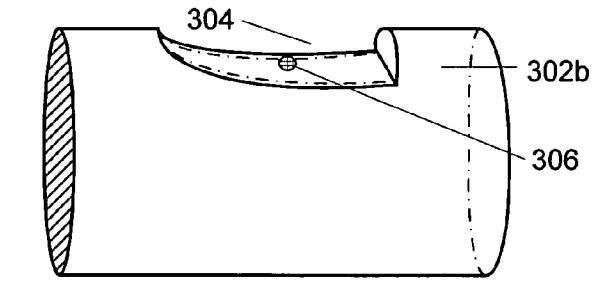
Figure 3B:
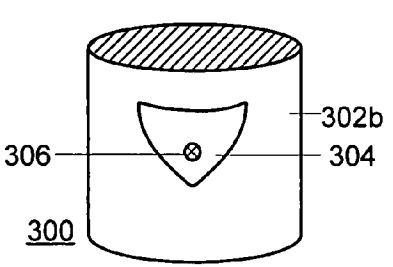

FIGS. 3Bi, 3Bii, and 3Biii, illustrate an improved hydraulic fluid cam 300 shown in a "graduated" position 302*b* with respect to valve timing and displacement. FIG. 3Bi is identical to FIG. 3Ai in every respect, with the exception that the port 306 is shown in a different placement relative to the cavity 304. This difference in placement of the port 306 is achieved by moving the hydraulic fluid cam 300 from a first cam lobe position ("maximum" position) 302*a* (as in FIG. 3Ai) to a second cam lobe position ("graduated" position) 302*b* (as in FIG. 3Bi) along a longitudinal axis of the camshaft.

Referring now to FIG. 3Biii, a variable "graduated" displacement graph 328 of valve displacement versus cam angle, corresponding to the first cavity 304 of the cam lobe position 302*b* shown in FIGS. 3Bi and 3Bii, is shown. The "graduated" displacement graph 328 illustrates a variable displacement curve 330, having a rounded portion as a valve lift displacement, corresponding to a variable valve cam angle and lift.

Figure 3C:
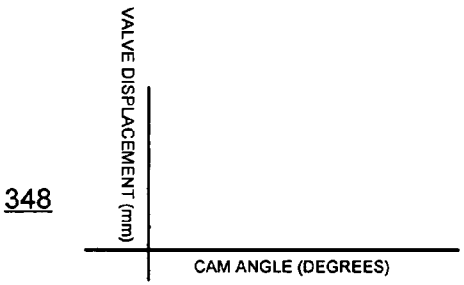
FIG. 3Ci illustrates a front view of the improved hydraulic fluid cam apparatus in a non-actuated position.
Figure 3C:
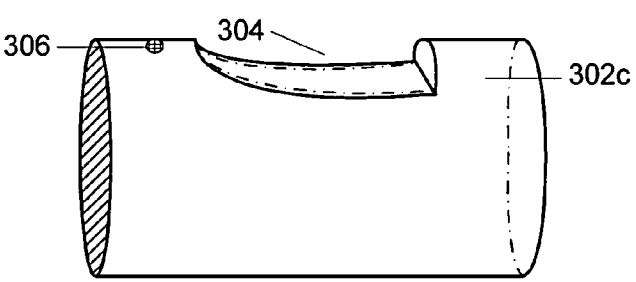
Figure 3C:
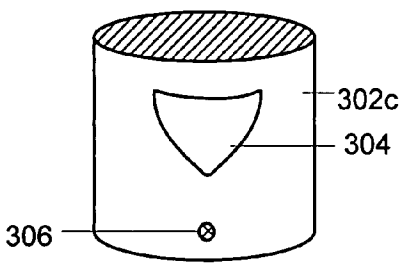

Referring now to FIGS. 3Ci, 3Cii, 3Ciii, an improved hydraulic fluid cam 300 is shown in a "non-actuated" position 302*c* with respect to valve timing and displacement.

FIG. 3Ci is a front view of an improved hydraulic fluid cam 300 apparatus shown in a non-actuated position 302*c*. As shown in FIG. 3Ci, the cam 300 is not activated because the port 306 is not in operative connection with the cavity 304. When positioned as shown in FIGS. 3Ci and 3Cii, no valves are actuated.

FIG. 3Ciii shows a non-actuated displacement graph 348, corresponding to the cam lobe position 302*c* of FIGS. 3Ci and 3Cii. The displacement graph 348 has no plotted points to describe valve actuation, because port 306 is not in contact with cavity 304, resulting in no valve actuation.

Figure 4C:
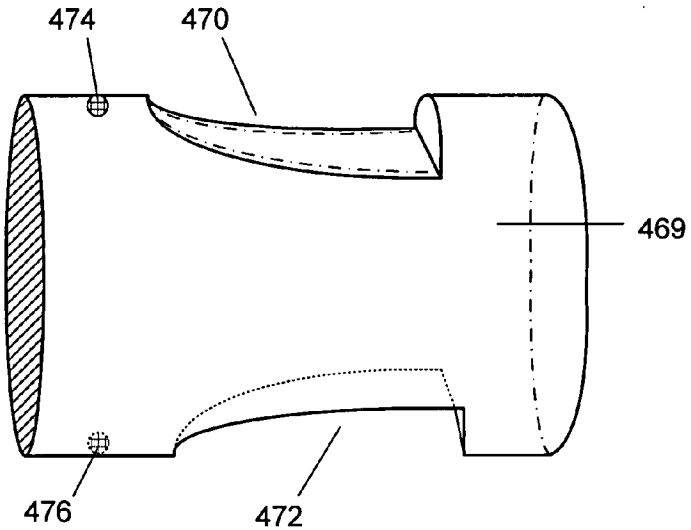
FIG. 4C illustrates an alternate embodiment of the present disclosure, in a non-actuated position.
Figure 4A:
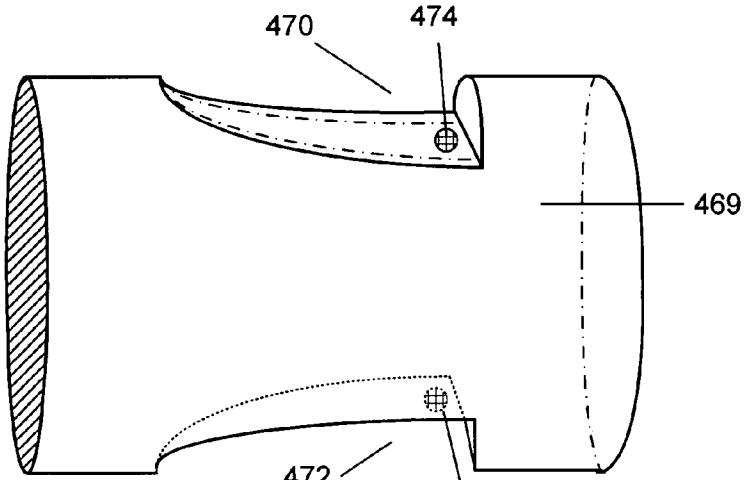
FIG. 4A illustrates an alternate embodiment of the present disclosure, in a maximum displacement position.

Referring now to FIG. 4A, an embodiment of the fluid cam 469 of the present teachings is illustrated in a maximum displacement position. In this embodiment, a first cavity 470 has a first predetermined shape, having a first width and a second width associated therewith, and is disposed in a first position as illustrated. A second cavity 472 has a second predetermined shape, having a first width and a second width associated therewith, and is disposed in a second position, as illustrated. FIG. 4A also shows a first port 474, disposed in the first cavity 470, and a second port 476, disposed in the second cavity 472, in a maximum valve displacement position on fluid cam 469.

Figure 4B:
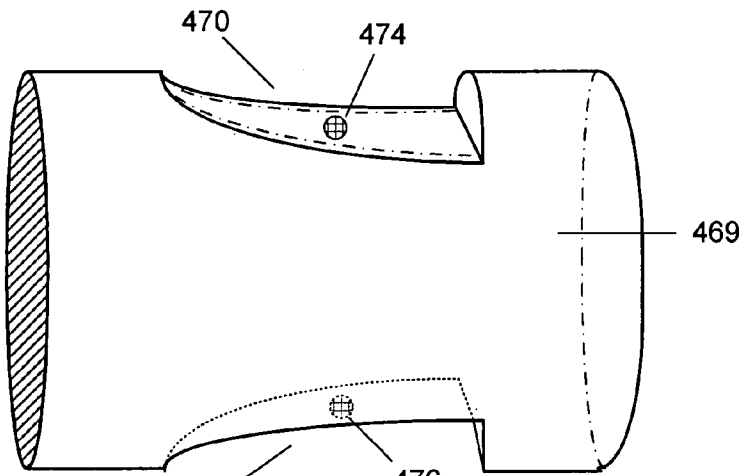
FIG. 4B illustrates an alternate embodiment of the present disclosure, in a graduated position.

Referring now to FIG. 4B, a fluid cam 469 is shown in a "graduated" position. The illustrated position is "graduated" in the sense that a depth and a width of the cavities 470 and 472 vary from the maximum position (as shown in FIG. 4A), toward a non-actuated position (as shown in FIG. 4C). As the fluid cam 469 is moved along a longitudinal axis (horizontally from left to right in the FIGS. 4A–4C), the fluid cam 469 moves from the maximum displacement position of FIG. 4A and into the graduated position of FIG. 4B. In this graduated position, the ports 474 and 476 have moved from the maximum displacement position of FIG. 4A into a position of graduated (i.e., variable) valve actuation. In the graduated position, the ports 474 and 476 contact the cavities 470 and 472, respectively, resulting in varying valve timings and varying valve displacement. In other words, the farther the ports 474 and 476 are positioned away from the maximum displacement position shown in FIG. 4A, the shorter the valve opening and closing periods become (i.e., variable valve timing) and the smaller the valve lift and duration become (i.e., displacement). However, as the ports 474, 476 approach closer and closer to the maximum displacement position shown in FIG. 4A, the valve opening and closing periods increase, and the valve lift and duration increases.

Referring now to FIG. 4C, a fluid cam 469 is shown in a non-actuated position. In this non-actuated position, the ports 474 and 476 are no longer in contact with their respective cavities 470 and 472. In this position, the valves are not actuated.

In some embodiments of the fluid cams shown in FIGS. 4A–4C, valve timing (cam phasing) is varied, while valve displacement is held constant. In other embodiments, valve timing is held constant, while valve displacement is varied.

Figure 5B:
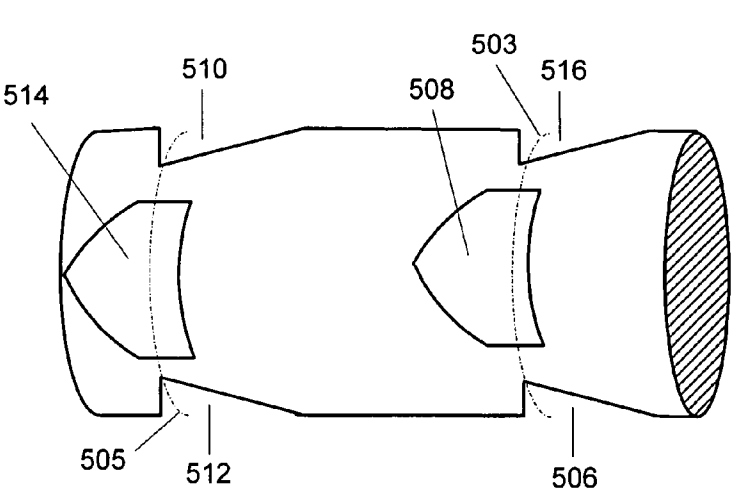
FIG. 5B illustrates a side view of the hydraulic camshaft lobe having main and additional cavities, corresponding to FIG. 5A.
Figure 5A:
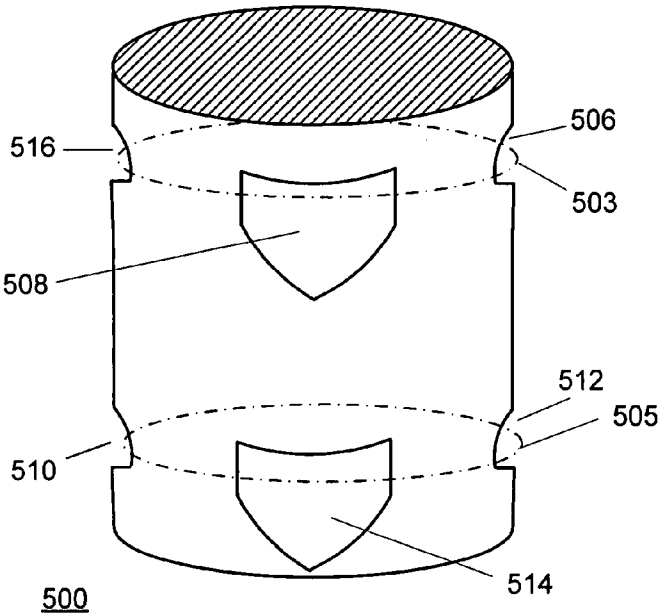
FIG. 5A illustrates a front view of a hydraulic camshaft lobe having main and additional cavities.

Referring now to FIGS. 5A and 5B, an improved variable valve train apparatus is described. FIG. 5A shows a front view of a variable timing/variable depth cam lobe 500. FIG. 5B shows a side view of the variable timing/variable depth cam lobe 500 of FIG. 5A. Main cavities 508, and 514 are substantially similar to the cavities described above with reference to FIGS. 1A–1I, FIGS. 3Ai–3Cii, and FIGS. 4A–4C. Additional cavities 506, 510, 512, and 516 function to provide additional actuation to vary valve timing and/or valve displacement. That is, when it is desired to have additional valve timing control (e.g., modulating valve stroke), the cam lobe 500 may optionally be shifted so that a valve will contact the cam lobe 500 at one of the main cavities 508 or 514, and the valve will also contact additional cavities 506, 516, or 510, 512. Similar to the main cavities 508 and 514, the additional cavities 506, 516, 510, and 512 have varying depths and widths, customizable by a designer to conform to specific engine design requirements.

As an engine changes a number of revolution per minute ("RPM"),it is desireable to change either the value timing or valve displacement, as such changes can dramatically improve engine horsepower and also conserve fuel. The cam lobe 500 is laterally actuated via hydraulic and/or electromechanical force, as will be appreciated by those of ordinary skill in the art. As the cam lobe 500 is laterally actuated, under either electromechanical or hydraulic force to vary a depth of at least one cavity 506, 510, 512, and 516 and/or vary a width of at least one cavity 506, 510, 512, and 516. Such variation of depth and width can be independently or simultaneously varied by selectively sliding the cavities 506, 510, 512, and 516, as will be described in more detail below with reference to FIG. 5D and 5F.

Figure 5C:
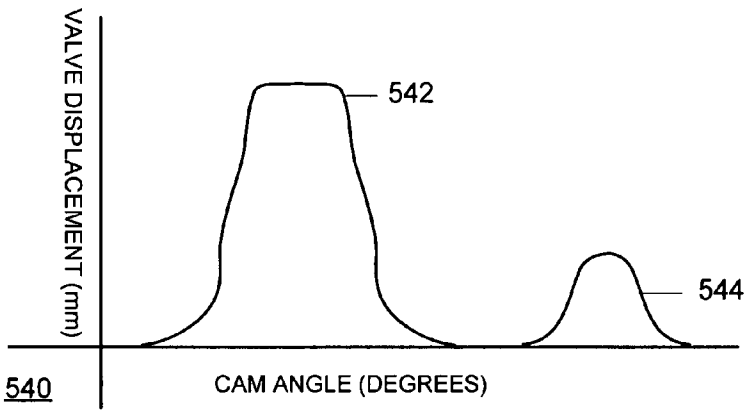
FIG. 5C illustrates a valve displacement diagram corresponding to the hydraulic camshaft lobe of FIG. 5A and FIG. 5B.

Referring now to FIG. 5C, a valve displacement versus cam angle graph 540 is shown. Peak 542 corresponds to a maximum valve displacement (lift), as shown in a flat, horizontal portion of peak 542. An exemplary displacement 544 is shown in FIG. 5C, indicating that the additional cavities 506, 510, 512, and 516 have been employed to actuate variable valve timing and/or displacement.

Figure 5D:
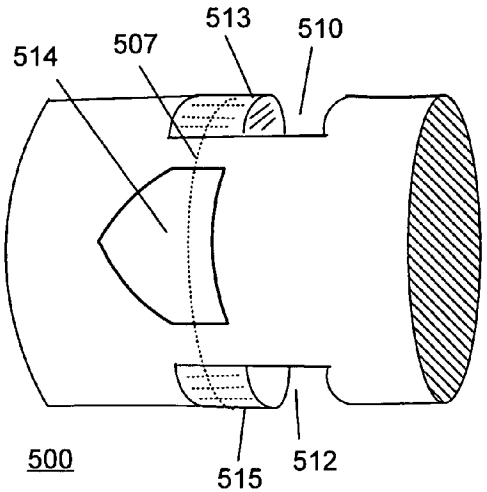
FIG. 5D illustrates a side view of a cam lobe having a main cavity and an additional cavity with a sliding block.
Figure 5F:
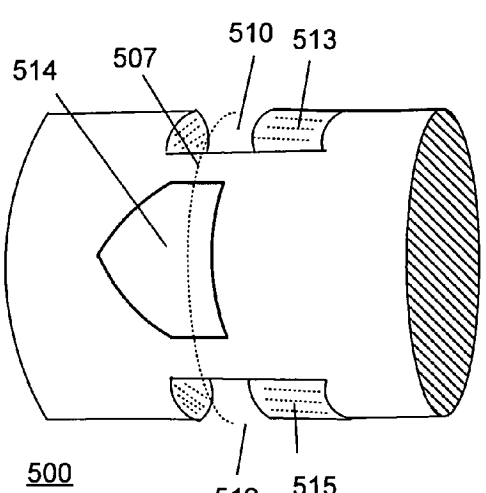
FIG. 5F illustrates a side view of another embodiment of a cam lobe having a main cavity and an additional cavity with a sliding block.
Figure 5E:
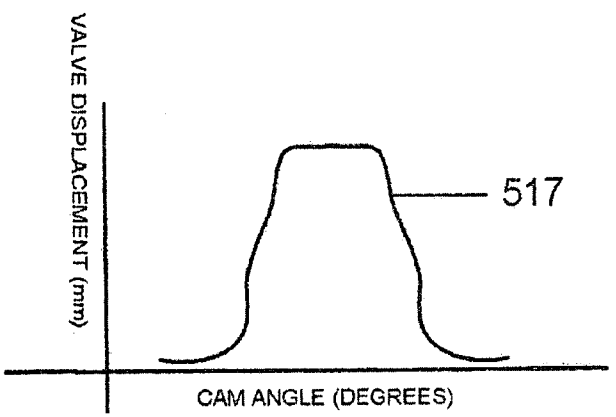
FIG. 5E illustrates a valve displacement diagram corresponding to the camshaft lobe of FIG. 5D.

Referring now to FIGS. 5D–5G, sliding cavity action of the cam lobe 500 is illustrated. FIG. 5D illustrates a side view of a cam lobe 500 having a main cavity 514 and an additional cavity 510 and 512 with a sliding block 513 and 515. FIG. 5D illustrates a main cavity 514 as providing primary valve actuation. When additional valve actuation is desired, at least one sliding block 513 and 515 may optionally be actuated from a first position to a second position. In the first position, the sliding blocks 513 and 515 do not provide additional valve actuation, as the main cavity 514 is providing all valve actuation as illustrated in the valve displacement diagram of FIG. 5E. FIG. 5E illustrates a single valve displacement of the main cavity 514 in a first position.

Figure 5G:
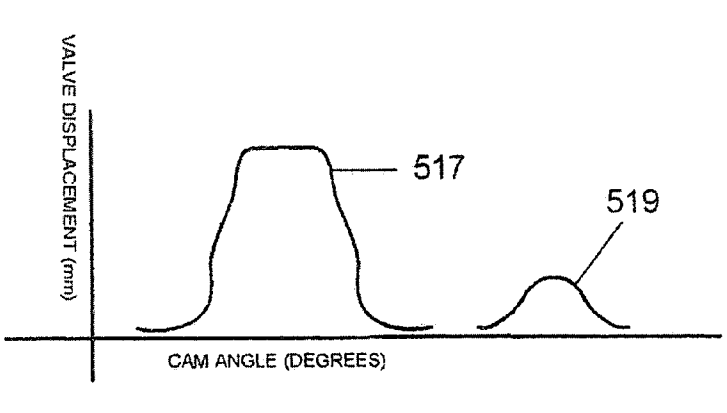
FIG. 5G illustrates a valve displacement diagram corresponding to the camshaft lobe of FIG. 5F.

FIG. 5F illustrates a side view of another embodiment of a cam lobe 500 having a main cavity 514 and an additional cavity 510 and 512 with a sliding block 513 and 515. FIG. 5F illustrates a second position of the cam lobe 500, wherein additional cavities 510 and 512 actuate laterally (along the longitudinal axis of the camshaft) and function to provide additional valve actuation, as illustrated in FIG. 5G. FIG. 5G illustrates a valve displacement diagram corresponding to the cam lobe 500 of FIG. 5F. A first curve 517 comprises the main cavity 514 actuation plot, while a second curve 519 comprises a contribution to variable valve timing and/or displacement from additional cavities 510 and 512.

In one embodiment, the width of at least one sliding cavity is varied, while maintaining the depth of the sliding cavities constant. By varying the widths of the sliding cavities while holding the cavity depths constant, valve timing is varied but valve displacement is held constant.

In yet another alternate embodiment of the improved variable train apparatus, both the depth and width of the sliding cavities 506, 510, 512, 513, 515, and 516 can be selectively varied. Varying the width and depth of the sliding cavities correspondingly varies both the valve timing and displacement. Small variations in valve depth and timing can be made in order to accommodate varying engine demands, such as, for example, those brought about when a vehicle is driven uphill.

Referring again to FIG. 5G, it is possible to obtain the second curve 519 without obtaining the first curve 517. As described above with reference to FIG. 5F, if the cam lobe 500 is positioned such that the main cavity 514 is not actuating a valve, then the first curve 517 is not present. In this configuration, it is possible to actuate the sliding blocks 513 and 515, such that a valve will be modulated in depth and/or timing, by the sliding blocks 513 and 515, thereby causing the second curve 519, even in the absence of the first curve 517. Additionally, although the present disclosure has described sliding blocks 513 and 515 partially overlapping the main cavities 514, one variation is constructing a sliding block 513 and 515 that, will span the entire length of the main cavities 514, thereby giving an engine designer more flexibility in the design process.

In one embodiment, a mechanical wedge, acting as a cavity actuation mechanism, actuates longitudinally along a longitudinal axis of the hydraulic camshaft lobe. The wedge has a leading portion and a trailing portion. The wedge slides inside at least one additional sliding cavity to vary either the width or the depth of the cavity. Actuated by either electromechanical or hydraulic force, the mechanical wedge controls the variable sliding action of the sliding cavities.

Cam phasing of valves can be accomplished in a manner of ways over an RPM range, using the present teachings. In one embodiment, the sliding cavities 513 and 515 are actuated via electromechanical or hydraulic force, and function to change the displacement and/or timing of the valves in the combustion chamber.

Each practical and novel combination of the elements and alternatives described hereinabove, and each practical combination of equivalents to such elements, is contemplated as an embodiment of the invention. Because many more element combinations are contemplated as embodiments of the invention than can reasonably be explicitly enumerated herein, the scope of the invention is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprising."

What is claimed is:

1. A hydraulic variable valve train apparatus, adapted for use in an engine having a combustion chamber, a hydraulic camshaft rotating in a timed relationship with a combustion sequence occurring in the combustion chamber, the hydraulic camshaft rotating along a circumferential axis of rotation of the hydraulic camshaft and comprising:

(a) a first graduated cavity disposed on a first portion of a hydraulic camshaft lobe and a second graduated cavity disposed on a second portion of the hydraulic camshaft lobe, wherein the hydraulic camshaft lobe rotates concentrically with the circumferential axis of rotation of the hydraulic camshaft;

(b) at least one valve operatively coupled to the hydraulic camshaft lobe; and (c) a hydraulic circuit adapted to actuate the at least one valve in the engine, the hydraulic circuit comprising:

(1) a hydraulic fluid source operatively coupled to the hydraulic camshaft lobe via a first inlet portion disposed at a first inlet port on the hydraulic camshaft and a second inlet portion disposed at a second inlet port on the hydraulic camshaft;

(2) a first control port operatively connected to a first control port side of the hydraulic camshaft lobe and a second control port operatively connected to a second control port side of the hydraulic camshaft lobe; and (3) a first exhaust port operatively connected to a first exhaust port side of the hydraulic camshaft lobe and a second exhaust port operatively connected to a second exhaust port side of the hydraulic camshaft lobe.

2. The hydraulic variable valve train apparatus as recited in claim 1, wherein the hydraulic fluid source comprises a hydraulic fluid pump.

3. The hydraulic variable valve train apparatus as recited in claim 1, wherein the hydraulic fluid source is a hydraulic fluid reservoir.

4. The hydraulic variable valve train apparatus as recited in claim 1, further adapted to vary a timing associated with an opening and a closing of the valve.

5. The hydraulic variable valve train apparatus as recited in claim 1, further adapted to vary a displacement associated with an opening and closing of the valve.

6. The hydraulic variable valve train apparatus as recited in claim 4, further adapted to vary a displacement associated with an opening and closing of the valve.

7. The hydraulic variable valve train apparatus of claim 1, wherein at least one of the first graduated cavity and the second graduated cavity comprises a continuous slope of changing depth from a first width to a second width.

8. A hydraulic fluid cam apparatus adapted for use in an engine, comprising:

(a) a first cavity having a first predetermined shape disposed on a hydraulic camshaft lobe, wherein the first predetermined shape has a first width on a first portion of the hydraulic camshaft lobe and a second width, narrower than the first width, on a second portion of the hydraulic camshaft lobe;

(b) at least one valve operatively coupled to the hydraulic camshaft lobe; and (c) a hydraulic circuit comprising:

(1) a hydraulic fluid source operatively coupled to the hydraulic camshaft lobe via a first inlet portion disposed at a first inlet port on the hydraulic camshaft lobe and a second inlet portion disposed at a second inlet port on the hydraulic camshaft lobe;

(2) a first control port operatively connected to a first control port side of the hydraulic camshaft lobe and a second control port operatively connected to a second control port side of the hydraulic camshaft lobe; and (3) a first exhaust port operatively connected to a first exhaust port side of the hydraulic camshaft lobe and a second exhaust port operatively connected to a second exhaust port side of the hydraulic camshaft lobe.

9. The hydraulic fluid cam apparatus as recited in claim 8, wherein the apparatus further comprises a second cavity having a second predetermined shape, wherein the second predetermined shape has a first width and a second width associated therewith.

10. The hydraulic fluid cam apparatus as recited in claim 9, wherein the hydraulic fluid source comprises a hydraulic fluid reservoir.

11. The hydraulic fluid cam apparatus as recited in claim 9, wherein the hydraulic fluid source comprises a hydraulic fluid pump.

12. The hydraulic fluid cam apparatus as recited in claim 9, wherein the hydraulic fluid cam is further adapted to provide an adjustment of valve timing and valve displacement.

13. The hydraulic fluid cam apparatus as recited in claim 9, wherein the hydraulic fluid cam is further adapted to provide cam phasing while holding cam displacement constant.

14. The hydraulic fluid cam apparatus of claim 8, wherein the first cavity comprises a continuous slope of changing depth from the first width to the second width.

15. A hydraulic camshaft apparatus adapted for use in an internal combustion engine having a combustion chamber, the hydraulic camshaft rotating in a timed relationship with a combustion sequence occurring in the combustion chamber, the hydraulic camshaft rotating along a circumferential axis of rotation of the hydraulic camshaft and comprising:

(a) at least a first main cavity disposed on a first portion of a hydraulic camshaft lobe and having a first and a second width and a first and a second depth, wherein the hydraulic camshaft lobe rotates concentrically with the circumferential axis of rotation of the hydraulic camshaft; and (b) at least one additional cavity disposed on a second portion of the hydraulic camshaft lobe, wherein the at least one additional cavity is adapted to have a varying depth and a variable width.

16. A method of controlling at least one of valve timing and valve displacement in an engine, the method comprising steps of:

providing an engine comprising the hydraulic camshaft lobe apparatus of claim 15; and during operation of the engine, adjusting at least one of the depth or the width of the at least one additional cavity disposed on a second portion of the hydraulic camshaft lobe so as to adjustably control at least one of the valve timing and the valve displacement of the engine.

17. A valve actuation apparatus including a hydraulic camshaft lobe, wherein the hydraulic camshaft lobe comprises:

(1) at least a first main cavity having at least a first depth and at least a first width associated therewith;

(2) at least one additional cavity having a variable width and a variable depth associated therewith;

(3) at least one additional cavity actuation mechanism associated with the at least one additional cavity, adapted to vary the width and further adapted to vary the depth of the at least one additional cavity; and (4) a sliding block, associated with the at least one additional cavity, the sliding block having a leading portion and a trailing portion, wherein the sliding block is adapted to slide inside the at least one additional cavity to provide the variable width and the variable depth of the at least one additional cavity.

18. A method of controlling at least one of valve timing and valve displacement in an engine, the method comprising steps of:

providing an engine comprising the valve actuation apparatus of claim 17; and during operation of the engine, sliding the sliding block inside the at least one additional cavity to adjustably control at least one of the valve timing and the valve displacement of the engine.

19. A hydraulic variable valve train apparatus adapted for use in an engine having a combustion chamber, a hydraulic camshaft rotating in a timed relationship with a combustion sequence occurring in the combustion chamber, the hydraulic camshaft rotating along a circumferential axis of rotation of the hydraulic camshaft and comprising:

(a) a first graduated cavity disposed on a first portion of a hydraulic camshaft lobe means and a second graduated cavity disposed on a second portion of the hydraulic camshaft lobe means, wherein the hydraulic camshaft lobe means rotates concentrically with the circumferential axis of rotation of the hydraulic camshaft means;

(b) at least one valve means operatively coupled to the hydraulic camshaft lobe means;

(c) a hydraulic circuit actuating means adapted to actuate the at least one valve in the engine, the hydraulic circuit actuating means comprising:

(1) a means for sourcing hydraulic fluid, operatively coupled to the hydraulic camshaft lobe means via a first inlet portion disposed at a first inlet port on the hydraulic camshaft means, and a second inlet portion disposed at a second inlet port on the hydraulic camshaft means;

(2) a first control port means operatively coupled to a first control port side of the hydraulic camshaft lobe means and a second control port means operatively coupled to a second control port side of the hydraulic camshaft lobe means; and (3) a first exhaust port means operatively coupled to a first exhaust port side of the hydraulic camshaft lobe means and a second exhaust port operatively coupled to a second exhaust port side of the hydraulic camshaft lobe means.

20. The hydraulic variable valve train apparatus of claim 19, wherein at least one of the first graduated cavity and the second graduated cavity comprises a continuous slope of changing depth from a first width to a second width.

* * * * *